US008747233B1

(12) United States Patent
Klein

(10) Patent No.: US 8,747,233 B1
(45) Date of Patent: Jun. 10, 2014

(54) GRIP ATTACHMENT WITH LED LIGHT FOR EXPANDABLE POLICE BATON

(71) Applicant: Charles Klein, Littleton, CO (US)

(72) Inventor: Charles Klein, Littleton, CO (US)

( * ) Notice: Subject to any disclaimer, the term of this patent is extended or adjusted under 35 U.S.C. 154(b) by 0 days.

(21) Appl. No.: 13/645,861

(22) Filed: Oct. 5, 2012

(51) Int. Cl.
*F41B 15/02* (2006.01)

(52) U.S. Cl.
USPC ..... 463/47.7; 362/102

(58) Field of Classification Search
USPC ..... 463/47.2–47.7; 362/103, 183, 253, 102, 362/109, 135
See application file for complete search history.

(56) References Cited

U.S. PATENT DOCUMENTS

| | | | | |
|---|---|---|---|---|
| 5,124,892 | A * | 6/1992 | Lambert | 362/103 |
| 6,082,872 | A * | 7/2000 | Ting | 362/205 |
| 6,283,609 | B1 | 9/2001 | Parsons et al. | |
| 7,014,333 | B2 * | 3/2006 | Tatebe | 362/191 |
| 7,300,172 | B1 * | 11/2007 | Lefler | 362/191 |
| 7,346,958 | B2 | 3/2008 | Parsons | |
| 7,641,353 | B2 | 1/2010 | Kostal et al. | |
| 7,703,937 | B2 * | 4/2010 | Shirey | 362/103 |
| 2005/0083679 | A1 | 4/2005 | Mackrowski et al. | |

* cited by examiner

*Primary Examiner* — William Pierce
(74) *Attorney, Agent, or Firm* — Edwin H. Crabtree; Ramon L. Pizarro

(57) ABSTRACT

A grip attachment with LED light or optional mirror adapted for attaching to one end of an expandable baton. The end of the baton has threads thereon. The grip attachment includes a grip body with a hand grip surface. The grip body having a center hole therethrough for receipt around the threaded end of the expandable baton. The grip body also includes an annular ring or tabs disposed around an inside circumference of the center hole. The grip attachment is secured on the expandable baton between the threaded end of the baton and an end cap. The grip attachment with LED light is attached to the baton by removing the end cap, sliding the grip attachment with LED light onto the threaded end of the baton, and screwing the end cap back on the threaded end.

14 Claims, 3 Drawing Sheets

GRIP ATTACHMENT WITH LED LIGHT FOR EXPANDABLE POLICE BATON

This application is based on an earlier filed provisional patent application, serial number U.S. 61/629,548, filed on Nov. 21, 2011 and claims the benefit of this earlier filed application.

FIELD OF INVENTION

The subject invention is generally related to nightsticks, batons, expandable police batons, and intermediate force weapons and is specifically related to a grip attachment with LED light for expandable police batons to improve their functionality and safety.

DESCRIPTION OF THE PRIOR ART

Expandable batons, such as those manufactured by ASP and Monadnock, have become the standard duty carry as an impact weapon for most law enforcement agencies and security personnel. One of the reasons for the popularity of expandable batons is the fact that they are much smaller in size that a traditional billy club or night sticks and can be easily attached to the gun belt of a law enforcement officer by means of a carrier or sheath specifically designed for this purpose, or carried in a pocket, bag, or other concealable location. Since expandable batons are collapsible, they can measure less than nine inches in length in the closed position, and expand to a lengths greater than eighteen inches in the extended position, with some variation among models currently on the market. The fact that expandable batons are small, lightweight, and effective, and the fact that they can be carried by law enforcement on the gun belt without interfering with the user's movement have made them preferable to traditional billy clubs or night sticks; which often hang down the leg of the user from a ring attached to the user's gun belt.

Expandable batons, such as those manufactured by ASP and Monadnock, are generally made with three separate telescoping sections, the outer largest section defining a handle adapted for receiving and nesting the remaining sections when the baton is in the collapsed position. When in the collapsed position, the baton is approximately 6 to 10 inches long and can be carried by law enforcement personnel in a suitable sheath or scabbard on the belt of the uniform. The baton is adapted to be drawn quickly from the sheath and opened in a swinging action for whipping the nested sections out to an extended position and locking them in position for use as an intermediate force or impact weapon.

In both the ASP and Monadnock expandable batons, the handle of the expandable baton contains an end cap which is screwed onto the end of the baton which keeps the nested sections from falling out of the largest handle section and allowing access to the nested parts for maintenance. The end cap is generally made up of a solid metal material with a portion that is threaded to allow the end cap to be screwed on to the handle section, which is also threaded to receive the end cap.

Generally, law enforcement personnel are required to carry a multitude of different weapons and tools on their gun belt including but not limited to a gun and holster, magazines and magazine case, two way radio, handcuffs and handcuff case, chemical irritant and case, and flashlight in addition to the expandable baton and sheath. Law enforcement officers typically carry additional items on their gun belt including key rings, gloves, a mirror, cell phone, and disposable restraints. When all of this equipment is positioned on the belt of the officer or elsewhere on the officer's uniform it becomes not only heavy but very uncomfortable and cumbersome to wear. Lighter equipment and smaller items that are easily accessible are generally preferable, and police supply manufacturers have responded to this demand by developing lighter and smaller tools such as smaller two way radios, shorter and lighter expandable batons, and smaller and lighter flashlights.

Since expandable batons and flashlights are often used in tandem by law enforcement personnel, there are several variations of prior art which have combined police batons and flashlights or lamps that can be mounted on police batons.

From the U.S. Pat. No. 7,641,353, a light attachment is known that can be attached to a baton, spray-defense apparatus, walking stick, or even a ski stick by means of an elastic sleeve which is stretched around the carrier structure. This device has several small batteries are stacked together inside of the structure which are connected to an LED light which is directed at a 90 degree angle, perpendicular to the baton. Due to the large size and means of attachment of this device to a baton, it is apparent that the attachment will greatly increase the grip circumference of the expandable baton. Additionally, it is apparent that by attaching this device to an expandable baton that the device will interfere with carrying a baton or expandable baton in a sheath or carrier, which are usually used by law enforcement and security personnel. The light emitted by this device is projected at a 90 degree angle perpendicular to the baton, which can be awkward to use since the user would have to hold the baton straight up or sideways to effectively illuminate a target. Lastly, due to the mechanism of attachment for this device by means of an elastic sleeve, it allows for the possibility that a police baton will separate from the light attachment and dislodge from the user's hand when performing strikes.

U.S. Pat. No. 6,283,609 discloses a tactical flashlight that is made to be attached to an ASP expandable baton. The small, cylindrical, push-button activated flashlight is secured to the end of an expandable baton by removing the end cap of the expandable baton and screwing the tactical flashlight into place. This device uses a light bulb rather than an LED light to produce illumination. Because this device is screwed onto the end of an expandable baton, the manufacturing of this device requires that it be threaded, which is expensive to produce. Another disadvantage to this device is the fact that by attaching this light to an expandable baton, it increases the length of the expandable baton by several inches, which is an undesirable feature for users of expandable batons. Expandable batons are generally carried in a sheath or carrier and are attached to the gun belt of a police or other law enforcement officer. The added length of the tactical light attachment can cause discomfort in carrying the weapon since the increased length can cause the baton to poke into the user's back while in the seated position. It is apparent that this device can only be used with the ASP expandable baton and not by expandable batons made by Monadnock since the end caps of these batons are not interchangeable due to manufacturing and design variations. Additionally, this device does not provide the benefit of a grip on the handle portion of the expandable baton to keep the baton from dislodging from the user's hands while conducting strikes.

U.S. Patent Publication No. 2005/0083679 discloses a straight handled baton with mushroom cap that may be converted into an expandable side handled baton. This product consists of an expandable baton with a detachable cylindrical side handle containing a spray canister that can be screwed on to the side of the baton to convert it to a side handle baton. The end cap of this baton includes a removable bulbous or mushroom shaped head. The head of the cap releasably receives a light device with a light element, and the end cap also contains a battery to power the light. The light element is placed behind a transparent head so that the light may penetrate through the transparent portion. It is apparent from the description and drawings that it does not contain a push button activation switch. This is a great disadvantage since law enforcement personnel need to have the ability to easily turn the light source on and off for safety reasons. The mushroom cap or end cap described in this publication serves as a grip since it has a larger circumference than the baton itself and assists to keep the expandable baton from dislodging from the user's hand while conducting strikes. This is a desirable feature, but is made possible only due to the fact that the entire end cap of this baton has a larger circumference than the rest of the baton. The end cap of this device is threaded, which is a disadvantage due to the higher manufacturing costs of producing an item with threading for this purpose. The mechanism of attachment for the handle containing a spray canister requires that threaded holes be drilled into the side of the baton; therefore, it is not designed to be used with any pre-existing expandable batons that are on the market and typically used by law enforcement. This invention disclosed in this publication consists of an entire expandable baton with an attachable side handle containing a spray canister, and does not relate to a grip attachment made for pre-existing batons.

U.S. Patent publication No. 2005/0076473 discloses a leveraged baton cap which can be removably placed onto existing batons. This device consists of a knob with a tapered neck portion that can be screwed on to the end of an expandable baton in place of an end cap. While this device serves as a grip that can be attached to an expandable baton to aid in weapon retention, it does not include any type of LED light or other light source. The means of attachment for this device is through internal threading so that it may be screwed onto the baton in place of an end cap. This is a disadvantage due to the higher manufacturing costs of producing an item with threading for this purpose. Additionally, since the leveraged baton cap is screwed onto the end of an expandable baton in place of the end cap, it can increase the length of the expandable baton, which is an undesirable feature for users of expandable batons.

U.S. Pat. No. 5,386,322 describes a mirror attachment for a baton, club or other object. It includes an arm with a receiving channel for releasably connecting the mirror attachment to the striking end of a baton. Unlike the present invention, the item described in this patent is attached to the striking end of the baton, and not the handle of the baton. The mirror attachment is carried by the user in their pocket, bag, or clipped onto their uniform or gun belt in some fashion and is attached to the striking end of a baton when needed to look around corners and to view objects that are otherwise inaccessible. It can be made with a clip to secure a small flashlight on the back side of the mirror as well to illuminate areas. The main disadvantage to this invention is the fact that the attachable mirror must be carried by the user in a pocket, bag, or otherwise attached to the user's uniform in addition to the multitude of other items that a law enforcement officer must already carry. When needed, this mirror must be located, and attached to the end of an expandable baton which takes additional time. Once attached to the striking end of a baton, the user can not use the baton for striking a subject or conducting defensive tactics techniques without likely damaging the mirror attachment.

SUMMARY OF THE INVENTION

The grip attachment with LED light for expandable police batons consists of a hand grip surface with a hole in the center that is large enough to slide onto the handle of an expandable baton. The grip attachment includes at least one LED light, batteries, and light source controlling switch which are built into it or otherwise attached to it. The hole in the center of the grip attachment with LED light contains an annular ring or tabs on the inside circumference which is designed to fit in between the ridge of the expandable baton's handle and the end cap.

The grip attachment with LED light is easily attached to an expandable baton by unscrewing and removing the end cap of a pre-existing expandable baton, sliding the grip attachment with LED light onto the expandable baton's handle, and replacing and screwing the end cap back on. The annular ring or tabs on the inside circumference of the hole in the center is sandwiched in between the end cap and the ridge of the expandable baton's handle, which secures the grip attachment in place and prevents it from or separating from an expandable baton.

The grip attachment with LED light slightly increases the circumference of the proximal end of an expandable baton's handle, thereby creating a barrier which helps to keep the expandable baton from sliding out of a user's hand when swinging the baton or conducting other defensive tactics techniques. The raised grip also aids the user with weapon retention if a combatant grabs the striking end of the expandable baton and attempts to seize control of the baton. The slightly increased circumference of the grip attachment with LED light is also advantageous because it causes the expandable baton to roll in a circle if it is dropped on the floor instead of rolling away from the user.

Unlike other known prior art, the grip attachment with LED light will not increase the length of an expandable baton and will not increase the circumference of the handle portion of an existing expandable baton. Due to the fact that the grip attachment with LED light does not alter the length or circumference of an existing expandable baton, it is compatible with all known sheaths or carriers made for expandable batons.

The grip attachment with LED light is superior to previously produced baton grips and baton flashlights because it incorporates a baton grip and a readily available light source into one product. The LED light incorporated into or attached to the grip attachment is useful for providing an immediately available light source for the user and can be activated by toggling the light source controlling switch which is located along the outer circumference of the grip attachment. Because of the novel means of attachment and placement of the grip attachment with LED light on the proximal end of the handle of the baton, it does not add any length to the expandable baton which makes it easier for users to carry on a gun belt or in a concealed carry position.

Since the grip attachment with LED light is not screwed into the end of an expandable baton like other known prior art, it does not need to be made of metal and does not require threading. It can be made from plastic or rubber or other durable material and can cost less to manufacture than other products on the market which do require threading.

The grip attachment with LED light is compatible with both the ASP and Monadnock expandable batons which are the leading manufacturers of expandable batons in the United States. Other baton attachments require threading and are not compatible with both ASP and Monadnock since the end caps of these batons are not interchangeable due to manufacturing and design variations.

The grip attachment with LED light can be easily attached to an expandable baton in seconds without causing any damage to the expandable baton. Likewise, it can be easily removed in seconds if needed without causing any damage.

The grip attachment with LED light incorporates an LED light which is easily activated with one hand from a position where the user is prepared to strike a target. Law enforcement officers typically carry expandable batons in what can be described as an overhand position where the expandable baton is carried at shoulder level or higher with the end cap of the baton pointed at a target. In carrying an expandable baton in this manner, the expandable baton rests in the palm of the user's hand with the user's fingers wrapped around the handle of the expandable baton so that the pinkie finger is closest to the target, and thumb farthest away from the target. When an expandable baton fitted with the grip attachment with LED light is held in this manner, the light emitted by the LED light is projected past the end cap of the expandable baton and onto the target. The user can activate the LED light with the same hand in which it is carried, which allows the user's other hand to remain free to control or handcuff a subject.

The grip attachment with LED light can be manufactured with several different colored LED lights. It can also be manufactured with a flashing or intermittent LED light that can serve as an emergency beacon since many LED lights are available with this capability. The light emitted by the LED bulb can be used to temporarily blind or disorient a subject prior to striking or at any time during a confrontation.

The grip attachment with LED light can be manufactured to incorporate a small mirror or other reflective device. This is a benefit to law enforcement and security personnel for use in looking around corners and objects while clearing rooms. In high risk or combat situations, law enforcement personnel may be required to look into rooms, or around corners or objects without exposing their body to gunfire or other trauma. In combat situations, such a move could prove to be fatal. By using a mirror or reflective device attached to the grip attachment with LED light to look around corners or objects, the user can significantly reduce their risk by looking around corners without exposing their body to gunfire or trauma.

The unique method of attaching the grip attachment with LED light onto an expandable baton includes the fact that the grip attachment with LED light is made with an annular ring or tabs that is secured between the ridge of the expandable baton's handle and the end cap. It is possible to use this mechanism of attachment to attach an LED light only onto an expandable baton without including a grip or barrier to assist with weapon retention. In this conception, an LED light could be made with an annular ring or tabs attached to it, whereby the annular ring or tabs serve to attach the LED light to an expandable baton.

Alternatively, the grip attachment with LED light can be manufactured with a removable LED light. In this conception, the grip attachment is secured to an expandable baton in the same manner as described prior. However, the grip portion is constructed with a hollow cavity where a small, pre-existing LED light can be snapped into place, and removed at will. This allows different colored LED lights to be used on the same device and facilitates the replacement of inoperable LED lights.

Other objects and features will be readily apparent from the accompanying drawings and descriptions.

DETAILED DESCRIPTION OF THE PREFERRED EMBODIMENT

Figure 1:
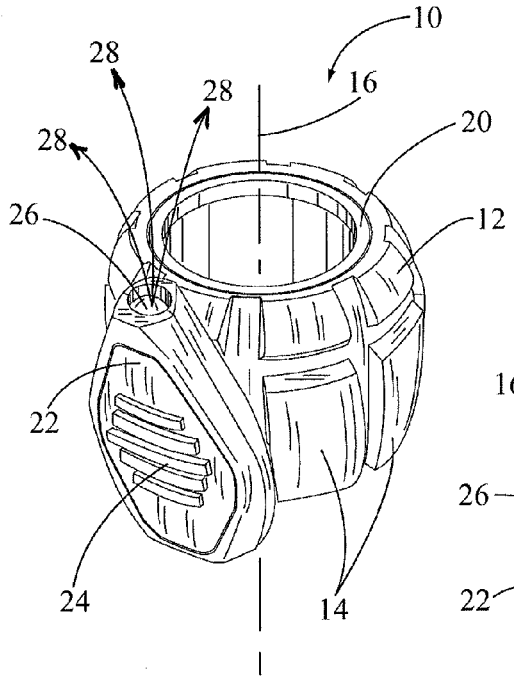
FIG. 1 is a perspective view of the grip attachment with an attached LED light.

In FIG. 1, the subject grip attachment is shown having a general reference numeral 10. Broadly, the grip attachment 10 includes a grip body 12 with a hand grip surface 14 and a center hole 16 through the grip body 12. At an upper end of the center hole 16 is a small annular ring 20 around the circumference of the hole. An LED light 22, with a light switch 24 and light bulb 26, is mounted on an outer portion of the grip body 12. When the light switch 24 is activated, the light bulb 26 provides illumination, indicated by arrows 28, outwardly from an upper portion of the grip attachment 10.

Figure 2:
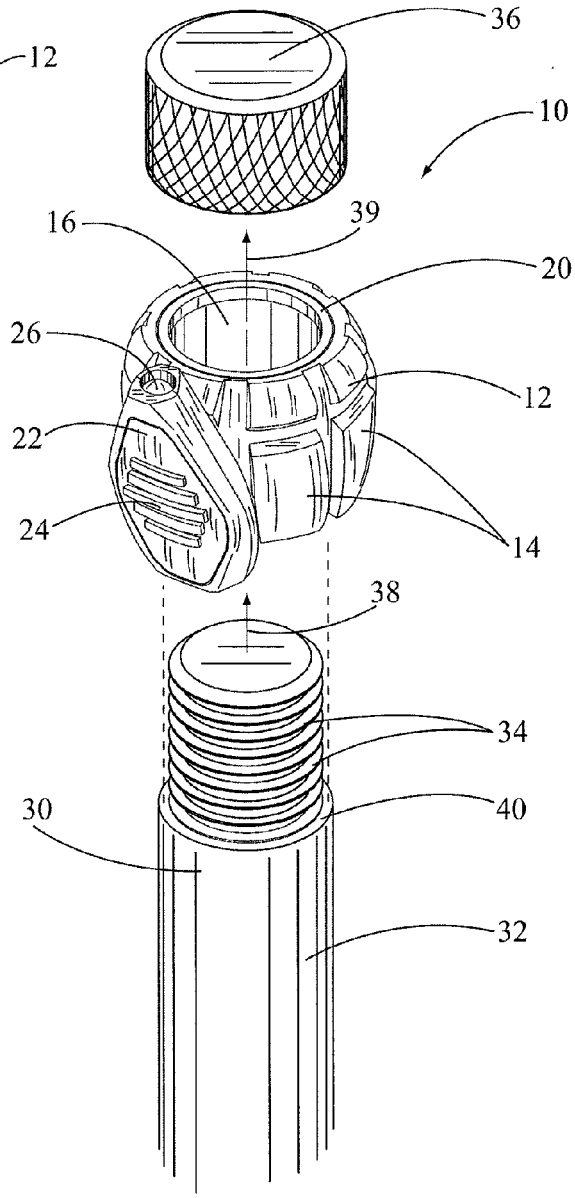
FIG. 2 is an exploded perspective view of the grip attachment with LED light positioned for attachment to an expandable baton.

In FIG. 2, the grip attachment 10 is shown positioned for attachment to one end 30 of an expandable baton 32. The one end 30 includes threads 34 for a threadable attachment to a threaded end cap 36. When the end 30 of the baton 32 is inserted through the center hole 16, as indicated by arrow 38, a ridge 40, next to the threads 34, engages the underside of the annular ring 20. The end 30 with the threads 34 now extends upwardly from the center hole 16, as indicated by arrow 39. At this time, the threaded end cap 36 is threaded on the threads 34 for securing the grip attachment 10 to the expandable baton 32.

Figure 3:
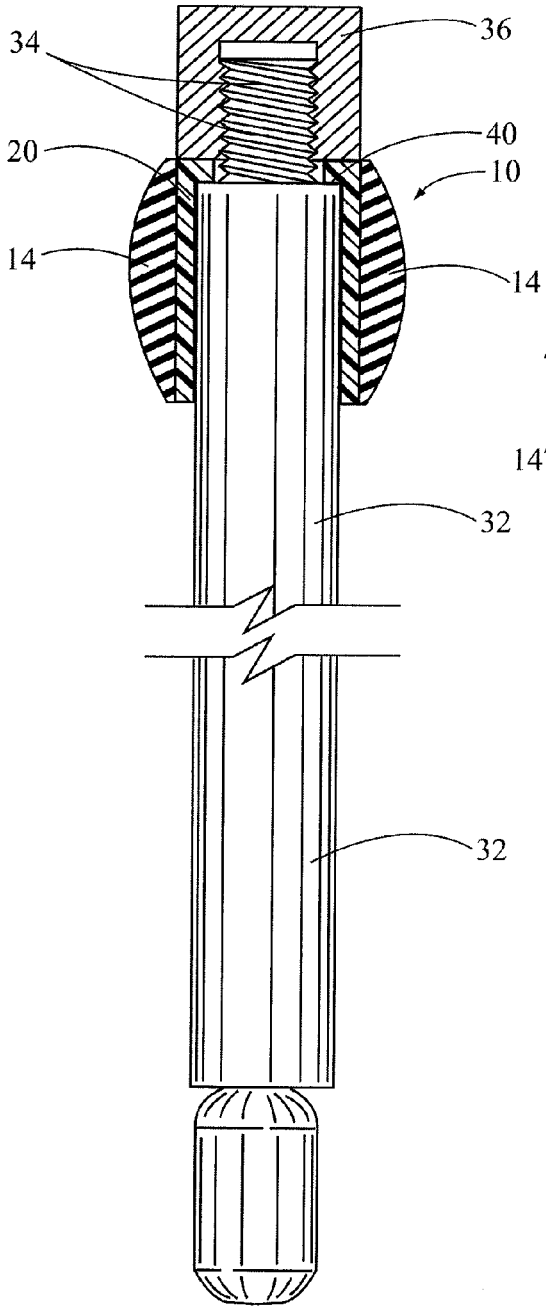
FIG. 3 is a front view of the grip attachment with LED light and attached to the expandable baton.

In FIG. 3, a cross-sectional view of the grip attachment 10 is shown and attached to the top of the expandable baton 32. The threaded end cap 36 is shown screwed on the threads 34 and on top of the ridge 40 for securing the grip attachment 10 on the expandable baton 32.

Figure 4:
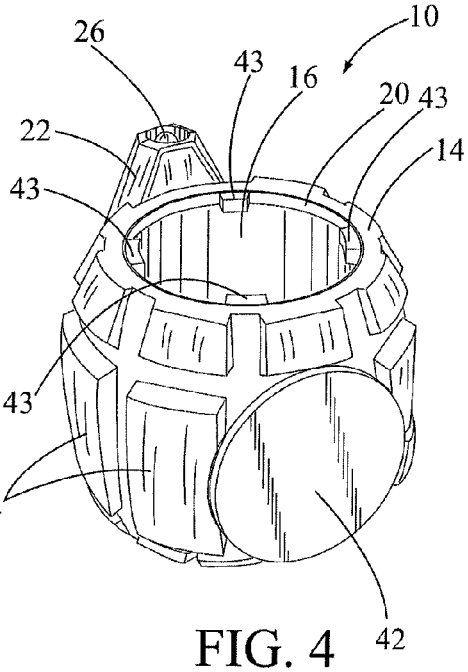
FIG. 4 is a perspective view of the grip attachment with a mirror or reflective device used in place of the LED light.

In FIG. 4, similar to FIG. 1, another embodiment of the grip attachment 10 is shown. In this example, a mirror 42 is attached to the hand grip surface 14. Instead of an annular ring, this figure shows the grip attachment 10 constructed with tabs 43 to secure the device in place. When the grip attachment 10, with a mirror 42, is used with the expandable baton 32, a law enforcement officer will be able to view an area around a corner without danger of exposing himself or herself.

Figure 5:
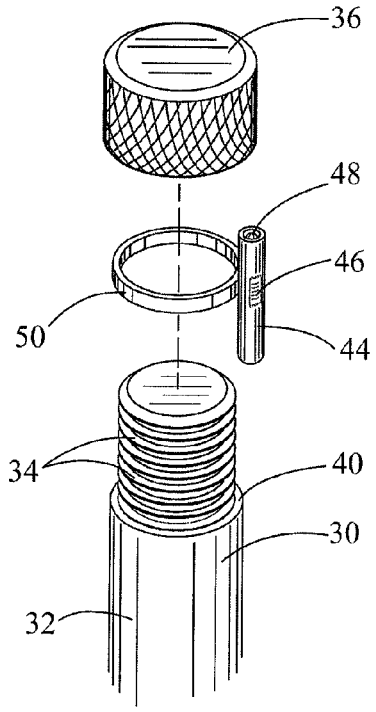
FIG. 5 is an exploded perspective view an LED light and a top portion of the expandable baton and without the grip attachment.

In FIG. 5, another embodiment of the invention is shown. In this example, a tubular LED light 44, with light switch 46 and light bulb 48, is shown mounted on an annular ring 50. The ring 50 is received around the threads 34 and on top of the ridge 40 of the expandable baton 32 and secured thereon, using the threaded end cap 36.

Figure 6:
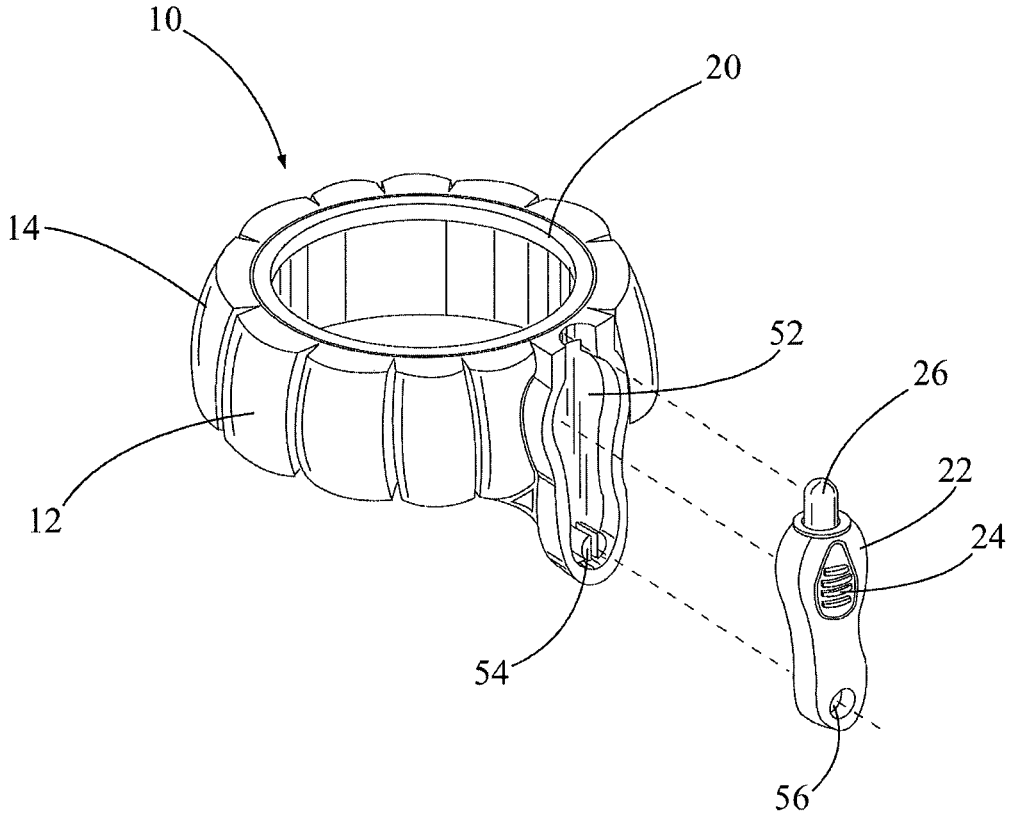
FIG. 6 is a perspective view of the grip attachment with a removable LED light.

In FIG. 6, another embodiment of the invention is illustrated with a removable LED light 22. The grip attachment 10 is shown with the hand grip surface 14 disposed around the annular ring 20. The grip body 12 is constructed with a hollow cavity 52, which is dimensioned for receiving the LED light 22 in a press fit. Also, an upwardly extending peg 54 is shown inside the cavity 52. The peg 54 is dimensioned to be received in a hole 56 in the light 22 for securing the it in place in the hollow cavity 52.

In the preferred embodiment, the grip attachment with LED light is constructed of plastic, rubber, or another durable material which will provide a comfortable yet firm grip for the user. Preferably, the grip attachment with LED light has an LED light on one hemisphere, and a small mirror on the other to provide the dual benefit of providing light and a mirror in one attachment. The light emitted from the grip attachment with LED light is directed to emit towards the end cap of the expandable baton so that the light can be activated from the overhand or underhand positions.

INDUSTRIAL APPLICABILITY

The grip attachment with LED light can be manufactured using multiple LED lights to produce more light or numerous colors.

The grip attachment with LED light can be made to incorporate a small canister of pepper spray or oleoresin capsicum (OC) spray or other chemical irritant of the type used by law enforcement in combination with or instead of an LED light. The spray can be deployed by itself in combination with conducting defensive tactics techniques with the expandable baton.

Using the unique mechanism of attachment for the grip attachment with LED light to an expandable baton, it is possible to incorporate additional items to an expandable baton such as stun gun or other device capable of producing an electrical current, a GPS device, an audio or video recorder, window breaker, or a blade or cutting device for cutting seat belts in emergency situations; all in combination with or instead of an LED light.

The embodiments of the subject invention for which an exclusive privilege an property right are claimed and defined as follows:

1. A grip attachment adapted for mounting on a threaded end of an expandable baton, the baton including a threaded end cap, the grip attachment comprising:

a grip body with hand grip surface, the grip body having a center hole, the center hole adapted for receipt around the threaded end of the expandable baton;

an annular ring disposed around a circumference of the center hole, the annular ring adapted for engaging a ridge next to threads on the threaded end of the baton when the threaded end cap is secured thereon; and light means attached to a portion of the grip body, the light means for illuminating an area during the use of the expandable baton.

2. The grip attachment as described in claim 1 wherein the light means is an LED light with a light switch and a light bulb.

3. The grip attachment as described in claim 2 wherein the grip attachment contains a hollow cavity therein, the hollow cavity dimensioned for receiving the LED light therein in a press fit.

4. The grip attachment as described in claim 2 wherein the LED light is an tubular-shaped LED light with light switch and light bulb.

5. The grip attachment as described in claim 1 further including a mirror attached to a portion of the grip body for viewing an area around a corner or around an object during the use of the expandable baton.

6. A grip attachment adapted for mounting on a threaded end of an expandable baton, the baton having a threaded end thereon, the baton including a threaded end cap, the grip attachment comprising:

a grip body with hand grip surface, the grip body having a center hole, the center hole adapted for receipt around the threaded end of the expandable baton;

tabs disposed around a circumference of the center hole, the tabs adapted for engaging a ridge next to threads on the threaded end of the baton when the threaded end cap is secured thereon; and light means attached to a portion of the grip body, the light means for illuminating an area during the use of the expandable baton.

7. The grip attachment as described in claim 6 wherein the light means is an LED light with a light switch and a light bulb.

8. The grip attachment as described in claim 7 wherein the grip attachment contains a hollow cavity therein, the hollow cavity dimensioned for receiving the LED light therein in a press fit.

9. The grip attachment as described in claim 6 further including a mirror attached to a portion of the grip body for viewing an area around a corner or around an object during the use of the expandable baton.

10. A grip attachment adapted for mounting on one end of an expandable baton, the baton having a threaded end thereon, the baton including a threaded end cap, the grip attachment comprising:

a grip body with hand grip surface, the grip body having a center hole, the center hole adapted for receipt around the threaded end of the expandable baton;

an annular ring disposed around a circumference of the center hole, the ring adapted for engaging a ridge next to threads on the threaded end of the baton when the threaded end cap is secured thereon; and a mirror attached to a portion of the grip body for viewing an area around a corner or around an object during the use of the expandable baton.

11. The grip attachment as described in claim 10 further including light means attached to a portion of the grip body, the light means for illuminating an area during the use of the expandable baton.

12. The grip attachment as described in claim 11 wherein the light means is an LED light with a light switch and a light bulb.

13. The grip attachment as described in claim 12 wherein the grip attachment contains a hollow cavity therein, the hollow cavity dimensioned for receiving the LED light therein in a press fit.

14. The grip attachment as described in claim 12 wherein the LED light is an tubular-shaped LED light with light switch and light bulb.

* * * * *